US005121824A

United States Patent [19]

Halsey et al.

[11] Patent Number: 5,121,824

[45] Date of Patent: * Jun. 16, 1992

[54] METER BOX WITH REMOVABLE HINGED DOOR

[75] Inventors: Johnny H. Halsey; James H. Halsey, both of El Dorado, Ark.

[73] Assignee: IDX, Inc., El Dorado, Ark.

[ * ] Notice: The portion of the term of this patent subsequent to Mar. 12, 2008 has been disclaimed.

[21] Appl. No.: 523,944

[22] Filed: May 16, 1990

Related U.S. Application Data

[63] Continuation-in-part of Ser. No. 336,146, Apr. 11, 1989, Pat. No. 4,998,612.

[51] Int. Cl.[5] ..... G07F 17/20

[52] U.S. Cl. ..... 194/350; 16/267; 49/398

[58] Field of Search ..... 194/241, 242, 350; 221/281; 109/50, 51, 52; 232/15, 16; 49/398; 16/267

[56] References Cited

U.S. PATENT DOCUMENTS

| | | | |
|---|---|---|---|
| 4,370,935 | 2/1983 | Link | 109/51 |
| 4,391,204 | 7/1983 | Mitchell et al. | 109/51 X |
| 4,437,558 | 3/1984 | Nicholson et al. | 194/320 X |
| 4,469,213 | 9/1984 | Nicholson et al. | 324/236 X |
| 4,579,214 | 4/1986 | Volk | 194/350 |
| 4,821,862 | 4/1989 | Nelson | 194/350 X |

*Primary Examiner*—F. J. Bartuska
*Attorney, Agent, or Firm*—Diller, Ramik & Wight

[57] ABSTRACT

A meter box defines an interior chamber and is closed by a door which fits the contour of front periphery of the meter box. The door carries hooks having open throats which are slidably received upon pivot pins or bosses welded to side walls of the meter box. This allows the door to be rapidly assembled to the meter box and disassembled therefrom.

25 Claims, 4 Drawing Sheets

METER BOX WITH REMOVABLE HINGED DOOR

CROSS-REFERENCE TO RELATED APPLICATION

This application is a continuation-in-part application of application Ser. No. 07/336,146 filed Apr. 11, 1989 in the names of Johnny H. Halsey and James H. Halsey entitled Meter Box with Hidden Hinged Door, and now U.S. Pat. No. 4,998,612 granted Mar. 12, 1991.

BACKGROUND OF THE INVENTION

This invention is directed to meter boxes into which coins or tokens are inserted to selectively condition machines for operation. The meter box of the present invention is particularly adapted for use in association with automobile or car washing installations in which the users insert appropriate coins/tokens into a coin/-token acceptor housed within the meter box, rotate a selector switch to condition the system to selectively dispense presoak, wash, rinse, or like solutions, and allow the solutions to be dispensed through a conventional manually operated trigger wand.

Since such conventional meter boxes are known to contain money, they are subject to vandalism, abuse, destruction, and theft. Furthermore, the latter or simple wear and tear requires components thereof to be repaired or replaced easily, quickly and correctly.

SUMMARY OF THE INVENTION

The present invention is directed to a novel meter box which is extremely sturdy and, therefore, resists all but the most destructive forces. However, apart from the rigidity of the meter box, the same is provided with a recessed front door which closely fits the contour of the front periphery of the meter box, and this in turn prevents screwdrivers, pry bars or similar tools from being used to break the door and gain access to the meter box. Furthermore, except for an exterior rotary switch and the lock, all of the components associated with the meter box are housed in an interior chamber thereof, including pivots for the door. Accordingly, except for total destruction of the meter box, the door can not be removed by exterior manipulation of the pivot pins or the removal thereof, as is possible in conventional meter boxes.

The door is also so constructed and arranged as to be disposed in a generally horizontal position when opened thereby exposing replaceable or repairable components for ready access which may be carried by the door itself or housed within the interior chamber of the meter box. In both of the latter aspects of the invention the door in its horizontal position offers a relatively stable flat work surface upon which components can be placed for repair and replacement. Preferably those components which are most subject to repair or replacement, particularly the rotary selector switch and the coin/token selector mechanism, are mounted upon the door, and of these the coin/token acceptor mechanism is preferably mounted on the door in a manner which permits access thereto only from the interior of the meter box.

Accordingly, in keeping with the present invention, the meter box must be virtually totally destroyed before its contents can be accessed and the exterior of the meter box offers no visual clue as to what might be the easiest illegal access to the meter box interior. Thus, with the meter box door closed the meter box represents an essentially vandal proof cabinet, yet when the door is disposed in its horizontal position, the components thereof are readily accessed, repaired and/or replaced.

In further accordance with the present invention, the meter box includes a cabinet defined by a bottom wall, a top wall, opposite side walls and a rear wall, and the side walls and meter box door include cooperative respective pivot pins and hooks with the latter having open throats for rapidly and readily assembling and disassembling the meter box door relative to the cabinet. This is a highly advantageous structure since tools are not required for the assembly or disassembly of the door relative to the meter box cabinet, the door and any electrical components carried thereby can be rapidly replaced by simply removing the door with the defective components and replacing the same with an entirely different door and associated operative components, and during cold or rainy weather, the time required to disassemble and reassemble the meter box door and any of the components associated therewith is appreciably reduced.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figures 1, 2:
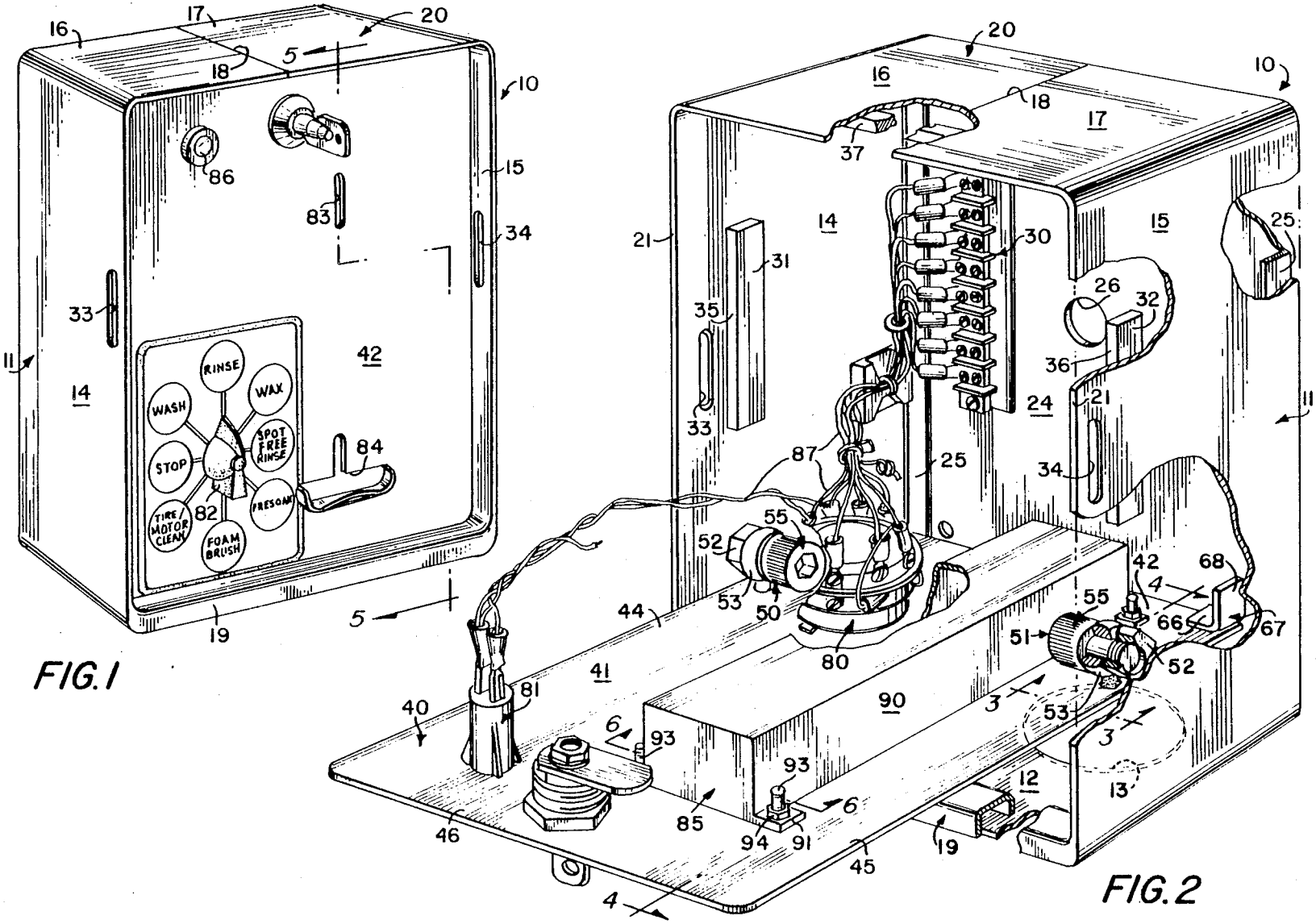
FIG. 1 is a front perspective view of a novel meter box or cabinet constructed in accordance with this invention, and illustrates a recessed front door carrying a rotary selector switch, a lock and a coin/token inlet and return slot.
FIG. 2 is an enlarged fragmentary perspective view of the meter box or the cabinet of FIG. 1 with parts broken away for clarity, and illustrates the door pivoted to its horizontal position, the pivots thereof, and the components carried by the door subject to replacement and/or repair.

A novel meter box or meter cabinet constructed in accordance with this invention and generally designated by the reference number 10 (FIGS. 1, 2, 4 and 5), and includes a generally tubular body 11 bent to a generally rectangular configuration and being defined by a bottom wall 12 (FIGS. 2, 4 and 5) having a central circular hole or an aperture 13 therein, opposite generally parallel side walls 14, 15, and the latter being bent into top wall portions 16, 17, respectively, welded at 18. The wall portions 16, 17 collectively define a top wall 20 which is generally parallel to the bottom wall 12. The generally polygonal or rectangular body 11 further is set-off by a front edge or edge portion 21 and a rear edge or edge portion 22. The front and rear edges 21, 22, respectively, lie in planes which are parallel to each other.

The tubular body 11 is closed along the rear edge 22 by a rear wall 24 which has an internally directed peripheral flange 25. The peripheral flange 25 bounds the entire periphery of the rear wall 24 and snuggly mates against the interior surfaces (unnumbered) of the walls 12, 14, 15 and 20, and is welded thereto along the rear edge 22 thereby rigidifying the rear side of the meter box 10. One or more openings 26 are formed in the rear wall 24. The opening 26 is utilized to connect an internal electrical contact board 30 conventionally fastened to the rear wall 24 to exterior circuitry forming no part of the present invention which permits the meter box 10 to be utilized with an appropriate mechanism, such as the car wash heretofore noted. The larger opening 13 in the bottom wall 12 can be used, for example, to secure the meter box 10 to a vertical support, such as a rigid stainless steel pipe to which the bottom wall 12 can be welded.

The bottom wall 12 is rigidified along the front edge 21 by means of a generally inverted U-shaped reinforcing member 19 having a generally horizontal bight wall 27, an outermost leg 28 and an innermost leg 29. The legs 28, 29 are welded to the front edge portion 21 of the bottom wall 12.

Two additional reinforcing and abutment members 31, 32 are welded to the respective side walls 14, 15 adjacent respective elongated slots 33, 34. The reinforcing and abutment members 31, 32 have respective front abutment surfaces 35, 36 which lie in a common plane which is also common to a front abutment surface 37 (FIGS. 2 and 5) of a reinforcing and abutment member 38 welded to the interior surface (unnumbered) of the top wall portions 16, 17.

A front door 40 of a generally rectangular or polygonal configuration is defined by an interior surface 41 which is relatively flat and planar, an exterior surface 42, a bottom edge or edge portion 42, opposite generally parallel side edges or side edge portions 44, 45 and a top edge or top edge portion 46. The overall profile of the door 40, as set off by the edges 42, 44, 45 and 46 corresponds to the overall profile of the front edge 21 as established by the corresponding walls 12, 14, 15 and 20. Thus, the door 40 in its closed position (FIGS. 1 and 5) is in snug, intimate contiguous relationship to the peripheral front edge portion 21 of the annular body 11, and is recessed approximately 1 inch therein. This snug fit and the recessed relationship virtually precludes a vandal or any other unauthorized individual from gaining access to an interior I of the meter box 10 by attempting to insert a screwdriver, pry bar or like tool between the door 40 and the annular body 11.

Figure 3:
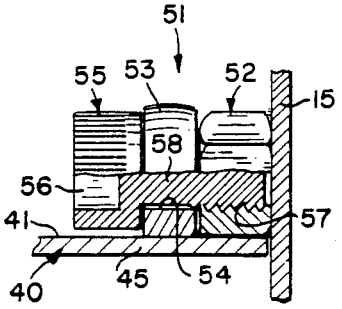
FIG. 3 is an enlarged view taken along line 3—3 of FIG. 2, partially in axial cross-section and partially in side elevation, and illustrates one of the two identical pivots for pivotally securing the door to a side wall of the meter box.
Figure 6:
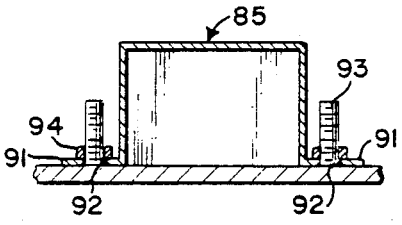
FIG. 6 is a cross-sectional view taken generally along line 6—6 of FIG. 2, and illustrates a coin/token comparator or acceptor secured to an internal surface of the door.

Identical means 50, 51 (FIG. 2) are provided for pivotally securing the door 40 to the side walls 14, 15, respectively, of the meter box 10 to facilitate pivoting movement of the door 40 between the closed position (FIGS. 1 and 5) thereof and the opened position (FIGS. 2 and 4) thereof. The pivot means 50, 51 each include an identical nut 52 welded to an inner surface (unnumbered) of the side walls 14, 15 (FIG. 3). An annular ring or pintle 53 having a circular opening 54 is also welded to the inner surface 41 of the door 40 at each of the side edges 44, 45. A cap screw 55 having a recessed head 56 is secured by a threaded end portion 57 to each of the nuts 52 while a cylindrical portion 58 of each cap screw 55 generally mates with and serves as a pivot for the associated pintle 53. The pivot means 50, 51 have a common or coaxial axis and, thus, the door 40 is pivoted relatively accurately between the two positions aforesaid. It should be particularly noted from FIGS. 1 and 3 that since the nuts 52 are welded to the interiors of the side walls 14, 15, the pivot means 50, 51 are not accessible from the exterior of the meter box 10, nor do the side walls 14, 15 even provide any indication that the door 40 is a door or is a pivoted door. Thus, anyone desiring to gain access to the interior I of the meter box 10 might quickly decide any effort at removing the front door panel 40 would prove difficult if not impossible, since no visible connection between the door 40 and the body 11 is evident from exterior inspection of the overall meter box 10. Furthermore, the door 40 is so locked in its closed position (FIGS. 1 and 5) as to further dissuade a vandal from attempting to open the same.

Figure 5:
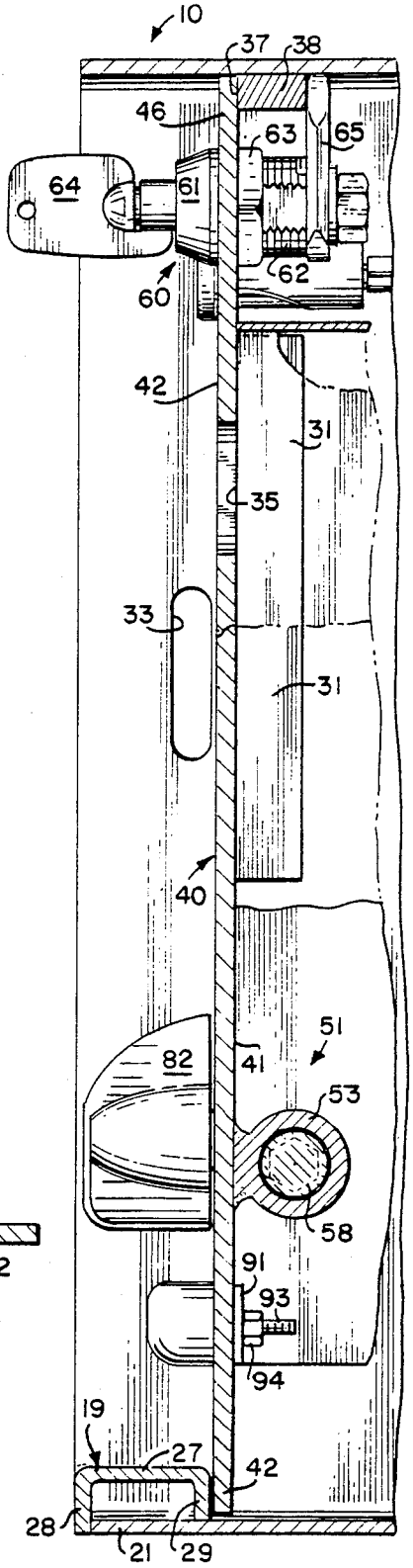
FIG. 5 is an enlarged fragmentary cross-sectional view taken generally along line 5—5 of FIG. 1, and illustrates the door in its vertical locked position.

Referring specifically to FIG. 5, when the door 40 is in its vertical/closed position, its inside surface 41 abuts the surfaces 35, 36 and 37, as heretofore noted, and its exterior surface 42 adjacent its bottom edge 42 abuts the outer surface (unnumbered) of the innermost leg 29 of the reinforcing member 26 (FIG. 5). Thus, the bottom, top and both side edges of the door 40 are rigidly abuttingly reinforced and are maintained in this relationship by conventional locking means 60 which is connected in an opening (not shown) of the front door 40. The locking means 60 includes an exterior annular shoulder 61 and a threaded stem 62 upon which is threaded a threaded nut 63 located within the interior chamber I. When the nut 63 is tightened, the shoulder 61 and the nut 63 intimately engage the door 40 and, obviously, the nut 63 can not be accessed unless the door 40 is opened or removed. A conventional key 64 can be inserted into the locking means or lock 60 to pivot a locking lug 65 between the locked position (FIG. 5) behind the reinforcing and abutment member 38 and an unlocked position (FIG. 2) at which the door 41 can be opened.

Figure 4:
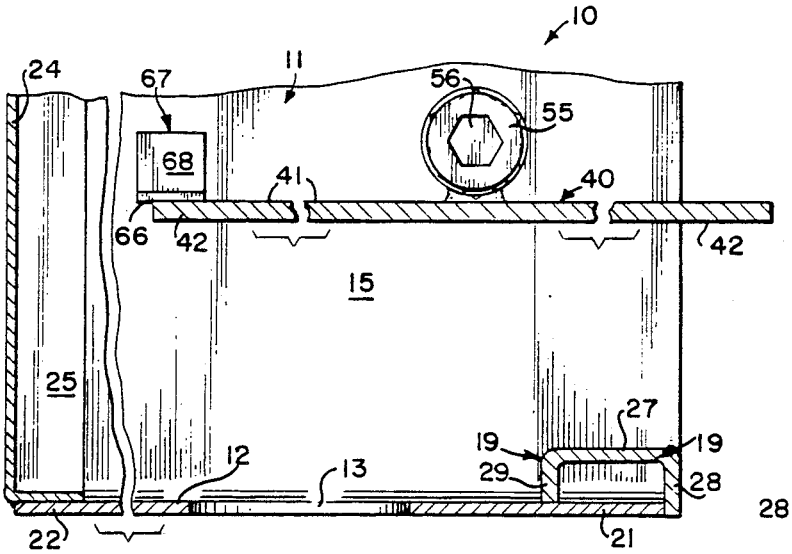
FIG. 4 is a fragmentary enlarged cross-sectional view taken generally along line 4—4 of FIG. 2, and illustrates the door in its horizontal position with a lower edge thereof contacting a stabilizer abutment carried by a side wall of the meter box.

When the door 40 is opened, the inner surface 41 adjacent the bottom edge 42 contacts a leg 66 of an angle bar abutment member 67 having another leg 68 welded to an interior surface of the wall 15 (FIGS. 2 and 4). A similar abutment member can be welded to the inner surface (unnumbered) of the side wall 14 with the leg (not shown) thereof corresponding to the leg 66 being aligned with the leg 66 of the illustrated angle-bar abutment member 67. Thus, when the door 40 is in its opened position, the upper surface 41 is maintained virtually horizontally disposed or in a horizontal plane which facilitates a person gaining access to various repairable/replaceable components housed within the interior I, such as the electrical contactor strip 30 carried by the rear wall 24 or other components, such as a conventional rotary switch 80, a conventional indicator light socket 81 and/or a conventional coin/token acceptor and comparator 85. The rotary switch 80 is suitably connected upon the interior surface 41 of the door 40 and has a manually operative stem (unnumbered) projecting through an opening (not shown) which in turn carries a knob or handle 82 which can be manually rotated to and through various positions appropriately marked on the front surface 42 of the door 40, such as "WASH", "RINSE", etc. When a coin or token is inserted through a slot 83 (FIG. 1) of the door 40 and is not discharged through a token/coin return slot 84, but is instead found "acceptable" by the coin/token acceptor mechanism 85, a light/bulb 86 in the socket 81 will light evidencing to a user that the knob 82 can then be selectively rotated, and the position of the knob 82 through electrical wiring 87 (FIG. 2) conditions the exterior mechanism associated with the meter box 10 for utilization as, for example, a conventional car washing mechanism having a trigger wand which can be directed toward an automobile during "WASH", "RINSE", etc. selections of the selector knob or switch 82. Whether a coin or token is accepted or rejected depends upon the conventional mechanics and circuitry of the coin/token acceptor/comparator, and though the details thereof are not specifically described herein, conventional mechanisms might be utilized as disclosed in Nicholson et al., U.S. Pat. Nos. 4,437,558 and 4,469,213, issued respectively Mar. 20, 1984 and Sep. 4, 1984 and entitled COIN DETECTOR APPARATUS and COIN DETECTOR SYSTEM, respectively. A typical coin comparator constructed in accordance with these patents is "Coin Comparitor Model CC-40" of Coin Mechanisms Inc. of 817 Industrial Drive, Elmhurst, Ill. 60126. The mechanical and electrical disclosures of the latter are incorporated hereat totally by reference in order not to unduly lengthen this disclosure.

Preferably a housing 90 of the comparator/acceptor 85 is provided with a number of identical flanges 91 each having an opening 92. A threaded stem 93 welded to the door 94 passes through each of the openings 92 of each of the flanges 91 and is secured thereto by a threaded speed nut 94. It should be particularly noted that due to the welding of the threaded stems 93 to the interior surface 41 of the door 40, there is no visual indication from the exterior of the door 40 when closed as to the precise location of the acceptor/comparator 85 relative to the door 40 or the manner in which the same is attached thereto. Thus, one attempting to gain access to the interior I might be inclined to make some judgements depending upon the location of the coin/token acceptor/comparator 85 thereof, but without knowledge of the manner in which the latter is secured within the interior I of the meter box 10, a vandal might find it difficult to make a sound judgement as to effecting entry to the meter box interior I.

Because of the location of the surface 41 in a generally horizontal plane when the door 40 is opened, those components which most likely can be damaged or jammed in use, such as the rotary switch 80, the lamp 86 of the lamp socket 81 and the coin/token acceptor/comparator can be readily removed from the door 40 and, for example, placed upon the horizontally disposed surface 41 incident to repair/replacement. Thus, the door 40 in its opened position is not only disposed in a generally horizontal plane, but it is rigidly supported in this plane by the abutment means 67, and this allows a technician/repairman to make whatever repairs/replacements might be necessary utilizing the surface 41 as a "work surface" to facilitate such replacement/repair. For example, the speed nuts 92 can be rapidly removed from the threaded stems 93, the mechanism 85 lifted from the restraint of the threaded stems 93 and repositioned upon the surface 41 for appropriate work/repair, and when the latter is completed, the mechanism 85 need be but returned to its original position, the speed nuts 94 reapplied, and the door 40 closed and locked.

As a precautionary measure, once the door is locked by the locking means 60, a conventional hardened steel security bar can be slipped through the slots 33, 34 and conventionally locked in place to further prevent unauthorized access to the interior I of the meter box 10.

Another novel meter box or meter cabinet constructed in accordance with this invention is generally designated by the reference number 110 (FIGS. 7 and 8), and includes a generally tubular body 111 bent to a generally rectangular configuration and being defined by a bottom wall 112 (FIG. 8) having a central circular hole or an aperture 113 therein, opposite generally parallel side walls 114, 115, and the latter being bent into top wall portions 116, 117, respectively, welded at 118. The wall portions 116, 117 collectively define a top wall 120 which is generally parallel to the bottom wall 112. The generally polygonal or rectangular body 111 further is set-off by a front edge or edge portion 121 and a rear edge or edge portion 122. The front and rear edges 121, 122, respectively, lie in planes which are parallel to each other.

The tubular body 111 is closed along the rear edge 122 by a rear wall 124 which has an internally directed peripheral flange 125. The peripheral flange 125 bounds the entire periphery of the rear wall 124 and snuggly mates against the interior surfaces (unnumbered) of the walls 112, 114, 115 and 120, and is welded thereto along the rear edge 122 thereby rigidifying the rear side of the meter box 110. One or more openings 126 are formed in the rear wall 124. The opening 126 is utilized to connect an internal electrical contact board (not shown but corresponding to the contact board 30 of FIG. 2) to the rear wall 124 which in turn is connected to exterior circuitry forming no part of the present invention. The larger opening 113 in the bottom wall 112 is used to secure the meter box 110 to a vertical support, such as a rigid stainless steel pipe, to which the bottom wall 112 can be welded.

The bottom wall 112 is rigidified along the front edge 121 by means of a generally inverted U-shaped reinforcing member 119 having a generally horizontal bight wall 127, an outermost leg 128 and an innermost leg 129. The legs 128, 129 are welded to the front edge portion 121 of the bottom wall 112.

Two additional reinforcing and abutment members 131, 132 (FIG. 8) are welded to the respective side walls 114, 115 adjacent respective elongated slots 133, 134. The reinforcing and abutment members 131, 132 have respective front abutment surfaces 135, 136 which lie in a common plane which is also common to a front abutment surface 137 (FIG. 8) of a reinforcing and abutment member 138 welded to the interior surface (unnumbered) of the top wall portions 116, 117.

A front door 140 of a generally rectangular or polygonal configuration is defined by an interior surface 141 which is relatively flat and planar, an exterior surface 142, a bottom edge or edge portion 149, opposite generally parallel side edges or side edge portions 144, 145 and a top edge or top edge portion 146. The overall profile of the door 140, as set off by the edges 149, 144, 145 and 146 corresponds to the overall profile of the front edge 121 as established by the corresponding walls 112, 114, 115 and 120. Thus, the door 140 in its closed position (FIG. 7) is in snug, intimate contiguous relationship to the peripheral front edge portion 121 of the annular body 111, and is recessed approximately 1 inch therein. This snug fit and the recessed relationship virtually precludes a vandal or any other unauthorized individual from gaining access to an interior I of the meter box 110 by attempting to insert a screwdriver, pry bar or like tool between the door 140 and the annular body 111.

Figures 7, 8:
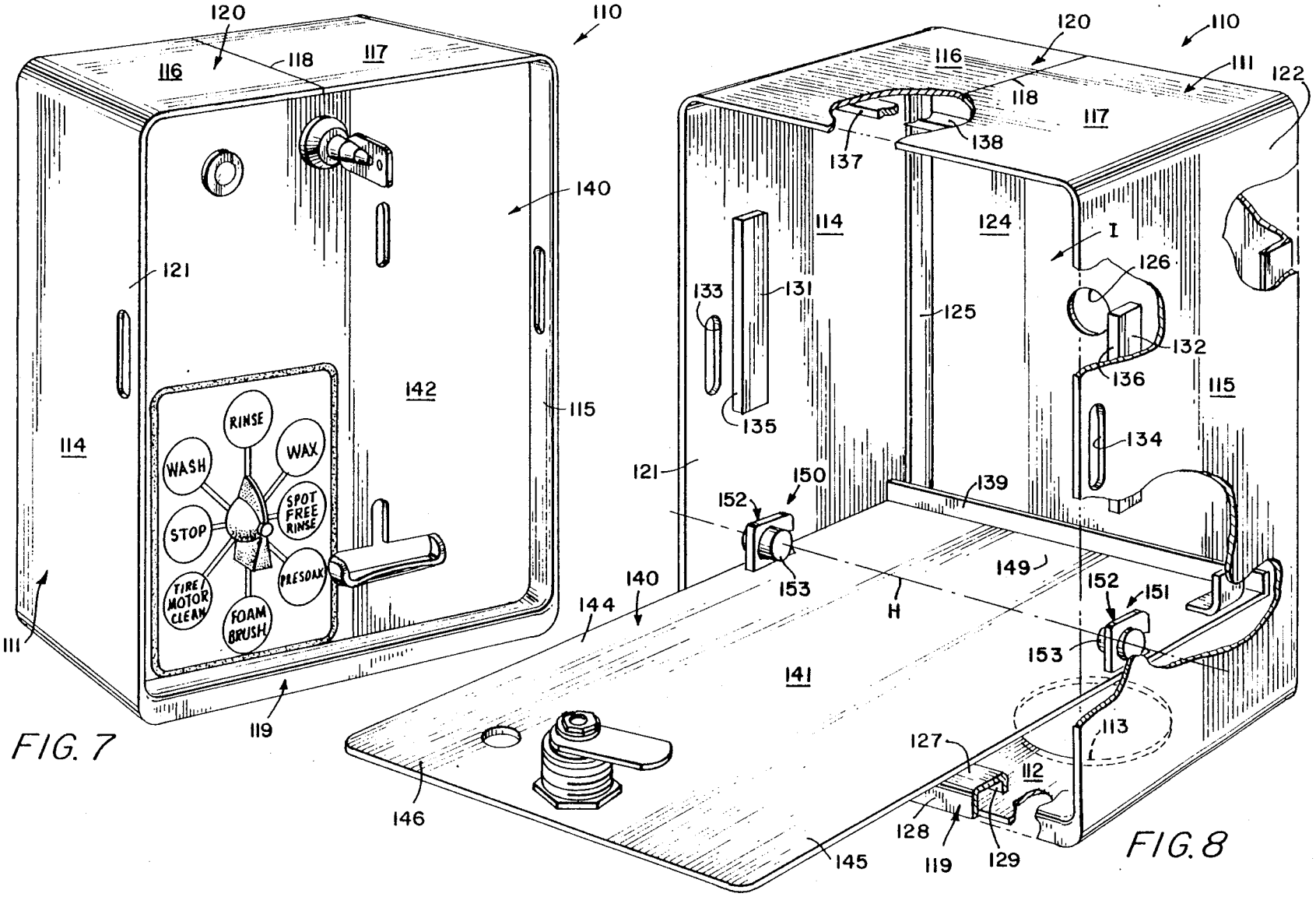
FIG. 7 is a front perspective view of another novel meter box or cabinet constructed in accordance with this invention, and illustrates a recessed front door carrying a rotary selector switch, a lock and a coin/token inlet and a return slot.
FIG. 8 is an enlarged fragmentary perspective view of the meter box or cabinet of FIG. 7 with parts broken away for clarity, and illustrates the door pivoted to its horizontal position and the pivots thereof which permit rapid assembly and disassembly of the door relative to the meter box cabinet.

Identical pivot means 150, 151 (FIGS. 8 through 12) are provided for pivotally securing or pivotally mounting the door 140 to the side walls 114, 115, respectively, of the meter box cabinet or cabinet body 111 to effect pivoting movement of the door 140 about a horizontal axis H between the closed vertical position (FIG. 7) and the open horizontal position (FIG. 8). The pivot means 150, 151 each includes identical hook means or hooks 152 welded to the inner surface 141 of the door 140 (FIGS. 8 through 12) and axially aligned pins or pintles 153 each welded to the inner surface (unnumbered) of an associated one of the side walls 114, 115 (FIG. 8). The pins 153 project toward each other a sufficient distance to be embraced by the hooks 152, as is most readily apparent from FIG. 8.

Figure 11:
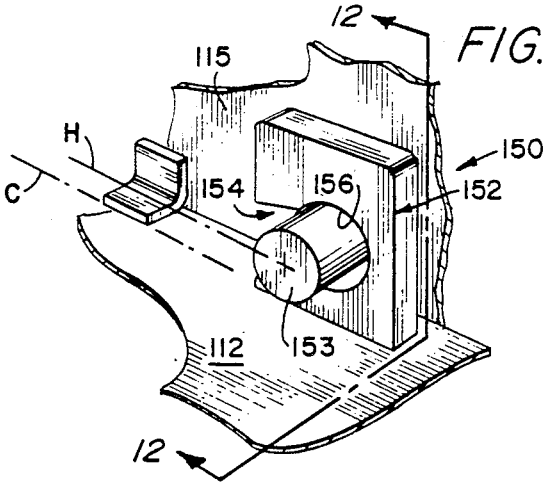
FIG. 11 is a fragmentary perspective view of the hook and pivot pin of FIG. 10, and illustrates the same in assembled relationship with an edge of the door underlyingly engaging a stop or abutment to maintain the door in a horizontal position.
Figure 12:
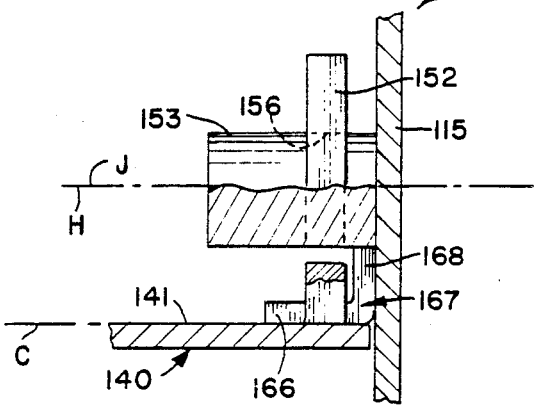
FIG. 12 is a cross-sectional view taken generally along line 12—12 of FIG. 11 with parts broken away for clarity, and illustrates the pivot pin and hook journalled for relative pivoting movement.

Each of the hooks 152 has open throat means or an open throat 154 (FIGS. 9 through 11) defined by an entrance slot or slot portion 155 and a jornalling surface 156 of a generally cylindrical configuration. The journalling surface 156 of each open throat 154 has an axis J coincident to the axis H of the pivot pins 153 when the hooks 152 and pivot pins 153 are in the assembled condition thereof (FIGS. 8, 11 and 12). Since the pivot pins 153 are welded to the interior surfaces (unnumbered) of the side walls 114, 115, the pivot means 150, 151 are not accessible from the exterior of the meter box 110, and the side walls 114, 115 do not provide any exteriorly indication that the door 140 is even a door or is a pivoted door. Thus, any one desiring to gain access to the interior I of the meter box 110 might quickly decide that any effort at removing the front door panel 140 would proved difficult, if not impossible, particularly since no visible connection is evident from an exterior inspection between the door 140 and the body 111. Furthermore, the door 140 is locked in its vertical position (FIG. 7) in identically the same manner as that heretofore described relative to the meter box 10 of FIGS. 1 through 6 and, obviously, this further dissuades a vandal from attempting to open the same.

Figure 9:
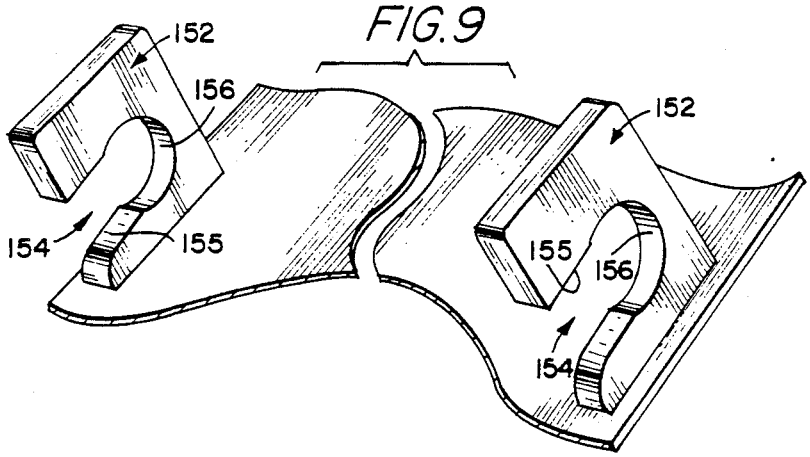
FIG. 9 is an enlarged fragmentary perspective view of the door of FIGS. 7 and 8, and illustrates the two hooks carried by the door, each having an open throat with the door being shown inclined incident to the hooks being hooked to the pivot pins of FIGS. 8 and 10 through 12 of the drawings.
Figure 10:
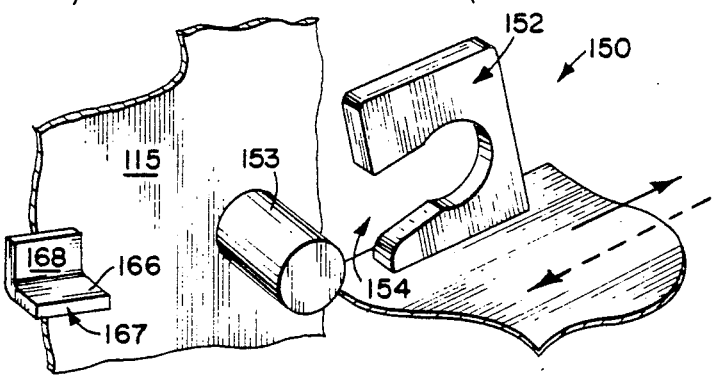
FIG. 10 is a fragmentary perspective view of the door and one of the hooks of FIG. 9, and illustrates the hook positioned immediately prior to being assembled upon an associated pivot pin.

Referring specifically to FIGS. 8 and 12, when the door 140 is in its horizontal open position, the inner surface 141 adjacent the bottom edge 149 contacts each of two legs 166 of an angle bar abutment member 167 having another leg 168 welded to an interior surface of the side walls 114, 115. The lowermost surfaces (unnumbered) of the legs 166 of the abutment members 167 lie in a contact plane C which also lies in the plane of the inner surface 161 of the door 140 (FIG. 12) when the door is in its open horizontal position. The contact plane C is below the axis H of the pivot pins 153, and the distance therebetween is selected to assure that the door 140 is disposed generally in a horizontal plane when in its open position (FIGS. 8 and 12). Obviously, when the door 140 is in its open position (FIGS. 8, 11 and 12), the upper surface 141 is thereby maintained virtually horizontally disposed or in a horizontal plane which facilitates a person gaining access to various repairable components housed within the interior I, such as the electrical contactor strip 30, the rotary switch 80, the light socket 81 and/or the conventional coin/token acceptor and comparator 85 of the meter box 10 which, though not illustrated, define at least in part the contents of the interior I of the meter box 110. However, in the case of the meter box 10, both cap screws 55 must be removed manually or by an appropriate tool to disassemble the door 40 from the cabinet body 11. However, in the case of the meter box 110, the door 140 is pivoted from its horizontal position toward an inclined position sufficient to allow an upstanding flange 139 of the door 140 to pass freely beneath the legs 166 of the angle abutment members 167. The door 140 is then pulled in the direction of the solid unnumbered headed arrow in FIG. 10 and the hooks 152 are thereby freed from the pins 153, thus allowing the door 140 to be totally disassembled from the cabinet 111 in the absence of fasteners, connectors or associated tools. Likewise, when the door 140 has been totally disassembled (FIG. 9), it can be replaced by an entirely new door or the components thereof can be repaired and the old door replaced. In either case the door 140 is replaced by again inclining the door 140 at an angle to the horizontal, as shown in FIG. 9, with the entry slots 156 aligned with the pins 153. The door is then moved toward the interior I in the direction of the unnumebered dashed arrow in FIG. 10 during which time the pins 153 enter the open throats 154 through the slots 155 and eventually seat in the journal portions 156 with, of course, the flange 139 eventually projecting beyond and upwardly above the abutment members 167. Obviously, the abutment members 167 prevent the door 141 from being thereon horizontally outwardly of the interior I, and this prevents the inadvertent or accidental removal of the door 141. Thus, a technician or repairman must necessarily recognize that the door 140 must be initially tilted or angled relative to the horizontal during assembly and disassembly, as heretofore described particularly with reference to FIGS. 9 and 10.

The meter box 110 is otherwise constructed identically to the meter box 10 with respect to the components of the latter which are not illustrated in FIGS. 7 through 12 nor described herein. However, such unillustrated and nondescribed components of the meter box 10 are herewith incorporated by reference with respect to the meter box 110.

Although a preferred embodiment of the invention has been specifically illustrated and described herein, it is to be understood that minor variations may be made in the apparatus without departing from the spirit and scope of the invention, as defined in the appended claims.

We claim:

1. A cabinet housing components which must be accessed for replacement or repair comprising a cabinet body defining an interior chamber adapted to house replaceable or repairable components, a door accessing said interior chamber through an associated opening, means for pivotally mounting said door relative to said cabinet body for pivoting movement about a horizontal axis between a first generally vertically disposed position and a second generally horizontally disposed position, means for releasably locking said door in said first position, means for slidably assembling and dissembling said pivotal means whereby said door and cabinet body can be relatively respectively assembled and disassembled, means for supporting said door in said second position whereby said door functions as a stable horizontal work surface during the replacement or repair of components adapted to be housed within said interior chamber, said cabinet body including a pair of opposite spaced side walls, said pivotal mounting means being in part carried by each of said side walls and in part by said doors, and said pivotal mounting means part carried by each of said side walls being welded to an interior surface of an associated side wall thereby being concealed from exterior view by said side walls.

2. The cabinet as defined in claim 1 wherein said slidable assembling and disassembling means includes pivot means carried by one of said door and cabinet body and hook means carried by the other of said door and cabinet body.

3. The cabinet as defined in claim 1 wherein said pivot mounting means includes a generally horizontal axis, and said pivotal mounting means horizontal axis is positioned in a plane above a plane of said door when said door is in the second generally horizontally disposed position thereof.

4. The cabinet as defined in claim 1 wherein said pivotal mounting means includes a generally horizontal axis, and said pivotal mounting means horizontal axis is positioned in a plane above a contact plane between said supporting means and said door when said door is in the second generally horizontally disposed position thereof.

5. The cabinet as defined in claim 1 wherein means are provided for preventing disassembly of said door and cabinet body by a force applied to said door in a direction outwardly of said interior chamber and opening when said door is in the second generally horizontally disposed position thereof.

6. The cabinet as defined in claim 1 wherein said cabinet body includes a rear wall opposite said opening, and said supporting means is disposed between said rear wall and said pivot means.

7. The cabinet as defined in claim 1 wherein said slidable assembling and disassembling means includes pivot means carried by one of said door and cabinet body, hook means carried by the other of said door and cabinet body, and said hook means includes open throat means for slidably embracing said pivot means.

8. The cabinet as defined in claim 1 wherein said cabinet body includes a rear wall opposite said opening, said slidable assembling and disassembling means includes pivot means carried by one of said door and cabinet body, hook means carried by the other of said door and cabinet body, said hook means includes open throat means for slidably embracing said pivot means, and said throat means opens in a direction toward said rear wall when said door is in the second generally horizontally disposed position thereof.

9. The cabinet as defined in claim 1 wherein said cabinet body includes a rear wall opposite said opening and a bottom wall generally transverse to said rear wall, said slidable assembling and disassembling means includes pivot means carried by one of said door and cabinet body, hook means carried by the other of said door and cabinet body, said hook means includes open throat means for slidably embracing said pivot means, said throat means opens in a direction toward said rear wall when said door is in the second generally horizontally disposed position thereof, and said throat means opens in a direction toward said bottom wall when said door is in the first generally vertically disposed position thereof.

10. The cabinet as defined in claim 1 wherein said slidable assembling and disassembling means includes pivot means carried by cabinet body, and hook means carried by said door.

11. The cabinet as defined in claim 1 wherein said cabinet body includes a rear wall opposite said opening and a pair of said walls in transverse relationship to said rear wall; and said slidable assembling and disassembling means includes pivot means carried by one of said door and a pair of side walls and hook means carried by the other of said door and pair of side walls.

12. The cabinet as defined in claim 1 wherein said pivot means are a pair of spaced pivots having a generally common axis.

13. The cabinet as defined in claim 1 wherein said pivot means are a pair of spaced pivots having a generally common axis, said hook means are a pair of spaced hooks, each hook has an open throat, each open throat includes an entrance slot and a journalling surface, said journalling surfaces have a generally common axis, and said axes are generally coincident in the first and second positions of said door.

14. The cabinet as defined in claim 1 wherein said pivot means are a pair of spaced pivots having a generally common axis, said hook means are a pair of spaced hooks, each hook has an open throat including a journalling surface, said journalling surfaces have a generally common axis, and said axes are generally coincident in the first and second positions of said door.

15. The cabinet as defined in claim 1 wherein said pivot means are a pair of spaced pivots having a generally common axis, said hook means are a pair of spaced hooks, each hook has an open throat including a journalling surface, said journalling surfaces have a generally common axis, said axes are generally coincident in the first and second positions of said door, and said pivots common axis is positioned in a plane above a plane of said door when said door is in the second generally horizontally disposed position thereof.

16. The cabinet as defined in claim 1 wherein said pivot means are a pair of spaced pivots having a generally common axis, said hook means are a pair of spaced hooks, each hook has an open throat including a journalling surface, said journalling surfaces have a generally common axis, said axes are generally coincident in the first and second positions of said door, and said pivots common axis is positioned in a plane above a contact plane between said supporting means and said door when said door is in the second generally horizontally disposed position thereof.

17. The cabinet as defined in claim 1 wherein said pivot means are a pair of spaced pivots having a generally common axis, said hook means are a pair of spaced hooks, each hook has an open throat including a journalling surface, said journalling surfaces have a generally common axis, said axes are generally coincident in the first and second positions of said door, and means are provided for preventing disassembly of said door and cabinet body by a force applied to said door in a direction outwardly of said interior chamber and opening when said door is in the second generally horizontally disposed position thereof.

18. The cabinet as defined in claim 1 wherein said pivot means are a pair of spaced pivots having a generally common axis, said hook means are a pair of spaced hooks, each hook has an open throat including a journalling surface, said journalling surfaces have a generally common axis, said axes are generally coincident in the first and second positions of said door, said cabinet body includes a rear wall opposite said opening, and said supporting means is disposed between said rear wall and said pivot means.

19. The cabinet as defined in claim 1 wherein said pivot means are a pair of spaced pivots having a generally common axis, said hook means are a pair of spaced hooks, each hook has an open throat including a journalling surface, said journalling surfaces have a generally common axis, said axes are generally coincident in the first and second positions of said door, means are provided for preventing disassembly of said door and cabinet body by a force applied to said door in a direction outwardly of said interior chamber and opening when said door is in the second generally horizontally disposed position thereof, and said disassembly preventing means includes stop means carried by said door for abuttingly engaging said support means when said door is in the second generally horizontally disposed position thereof.

20. A meter box comprising a cabinet body, said cabinet body including spaced top and bottom walls, spaced side walls and a rear wall collectively defining an interior chamber having an open opposite said rear wall; a door for accessing said interior chamber, means for pivotally mounting said door for pivoting movement about a horizontal axis between a first generally vertically disposed position and a second generally horizontally disposed position, said door having upper and lower end portions, said pivotal mounting means being located at said lower end portion whereby a major portion of said work surface projects outwardly of said interior chamber in said second position, said pivotal mounting means being accessible only from the interior chamber, said pivotal mounting means includes a pair of pivot pins having a generally common axis and a pair of hooks each having an open throat, said pivot pins being carried one each by said wide walls in projecting opposing relationship to each other, said pair of hooks being carried by said door with an open throat of each hook pivotally embracing an associated pivot pin, said open throats open toward said bottom wall and said rear wall when said door is in the respective first vertical and second horizontal positions thereof, and means for preventing disassembly of said door and cabinet body by a force applied to said door in a direction outwardly of said interior chamber and opening when said door is in the second generally horizontally disposed position thereof.

21. A cabinet housing components which must be accessed for replacement or repair comprising a cabinet body defining an interior chamber adapted to house replaceable or repairable components, a door accessing said interior chamber through an associated opening, means for pivotally mounting said door relative to said cabinet body for pivoting movement about a horizontal axis between a first generally vertically disposed position and a second generally horizontally disposed position, means for releasably locking said door in said first position, means for slidably assembling and dissembling said pivotal means whereby said door and cabinet body can be relatively respectively assembled and disassembled, means for supporting said door in said second position whereby said door functions as a stable horizontal work surface during the replacement or repair of components adapted to be housed within said interior chamber, means for preventing disassembly of said door and cabinet body by a force applied to said door in a direction outwardly of said interior chamber and opening when said door is in the second generally horizontally disposed position thereof, said cabinet body including a rear wall opposite said opening, said slidable assembling and disassembling means including pivot means carried by one of said door and cabinet body, hook means carried by the other of said door and cabinet body, said hook means includes open throat means for slidably embracing said pivot means, and said throat means opens in a direction toward said rear wall when said door is in the second generally horizontally disposed position thereof.

22. A cabinet housing components which must be accessed for replacement or repair comprising a cabinet body defining an interior chamber adapted to house replaceable or repairable components, a door accessing said interior chamber through an associated opening, means for pivotally mounting said door relative to said cabinet body for pivoting movement about a horizontal axis between a first generally vertically disposed position and a second generally horizontally disposed position, means for releasably locking said door in said first position, means for slidably assembling and dissembling said pivotal means whereby said door and cabinet body can be relatively respectively assembled and disassembled, means for supporting said door in said second position whereby said door functions as a stable horizontal work surface during the replacement or repair of components adapted to be housed within said interior chamber, said cabinet body including a rear wall opposite said opening, said slidable assembling and disassembling means including pivot means carried by one of said door and cabinet body, hook means carried by the other of said door and cabinet body, said hook means includes open throat means for slidably embracing said pivot means, said throat means opens in a direction toward said rear wall when said door is in the second generally horizontally disposed position thereof, and means for preventing disassembly of said door and cabinet body by a force applied to said door in a direction outwardly of said interior chamber and opening when said door is in the second generally horizontally disposed position thereof.

23. The cabinet as defined in claim 22 wherein said throat means opens in a direction toward said bottom wall when said door is the first generally vertically disposed position thereof.

24. A cabinet housing components which must be accessed for replacement or repair comprising a cabinet body defining an interior chamber adapted to house replaceable or repairable components, a door accessing said interior chamber through an associated opening, means for pivotally mounting said door relative to said cabinet body for pivoting movement about a horizontal axis between a first generally vertically disposed position and a second generally horizontally disposed position, means for releasably locking said door in said first position, means for slidably assembling and dissembling said pivotal means whereby said door and cabinet body can be relatively respectively assembled and disassembled, means for supporting said door in said second position whereby said door functions as a stable horizontal work surface during the replacement or repair of components adapted to be housed within said interior chamber, said cabinet body including a rear wall opposite said opening, said slidable assembling and disassembling means including pivot means carried by one of said door and cabinet body, hook means carried by the other of said door and cabinet body, said hook means includes open throat means for slidably embracing said pivot means, said throat means opens in a direction toward said rear wall when said door is in the second generally horizontally disposed position thereof, said cabinet body includes a pair of opposite spaced side walls, said pivot means being carried by one of said door and side walls, said hook means being carried by the other of said door and side walls, and one of said pivot means and hook means being welded to an interior surface of an associated side wall thereby being concealed from exterior view by said side walls.

25. A cabinet housing components which must be accessed for replacement or repair comprising a cabinet body defining an interior chamber adapted to house replaceable or repairable components, a door accessing said interior chamber through an associated opening, means for pivotally mounting said door relative to said cabinet body for pivoting movement about a horizontal axis between a first generally vertically disposed position and a second generally horizontally disposed position, means for releasably locking said door in said first position, means for slidably assembling and dissembling said pivotal means whereby said door and cabinet body can be relatively respectively assembled and disassembled, means for supporting said door in said second position whereby said door functions as a stable horizontal work surface during the replacement or repair of components adapted to be housed within said interior chamber, said cabinet body including a rear wall opposite said opening, said slidable assembling and disassembling means including pivot means carried by one of said door and cabinet body, hook means carried by the other of said door and cabinet body, said hook means includes open throat means for slidably embracing said pivot means, said throat means opens in a direction toward said rear wall when said door is in the second generally horizontally disposed position thereof, said cabinet body includes a pair of opposite spaced side walls, said pivot means being carried by said side walls, said hook means being carried by said door, and said pivot means being welded to an interior surface of an associated side wall thereby being concealed from exterior view by said side walls.

* * * * *